US010126024B1

(12) United States Patent
Chui et al.

(10) Patent No.: US 10,126,024 B1
(45) Date of Patent: Nov. 13, 2018

(54) CRYOGENIC HEAT TRANSFER SYSTEM

(71) Applicant: The United States of America as Represented by the Administrator of NASA, Washington, DC (US)

(72) Inventors: Talso C. Chui, Altadena, CA (US); Mark A. Weilert, Pasadena, CA (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 468 days.

(21) Appl. No.: 14/859,429

(22) Filed: Sep. 21, 2015

Related U.S. Application Data

(60) Provisional application No. 62/055,868, filed on Sep. 26, 2014.

(51) Int. Cl.

| | |
|---|---|
| ***F25B 9/00*** | (2006.01) |
| ***F25B 9/10*** | (2006.01) |
| ***F25B 9/14*** | (2006.01) |
| ***F25D 19/00*** | (2006.01) |
| ***F28D 1/00*** | (2006.01) |
| ***F28F 1/00*** | (2006.01) |

(52) U.S. Cl.
CPC ..... *F25B 9/14* (2013.01); *F25B 9/00* (2013.01); *F25B 9/10* (2013.01); *F25D 19/00* (2013.01); *F28D 1/00* (2013.01); *F28F 1/00* (2013.01)

(58) Field of Classification Search
CPC ..... F25B 9/00; F25B 9/10; F25B 9/14; F25B 9/145; F17C 3/085; F17C 2227/0372; F17C 2227/0337; F17C 2221/017; F17C 2203/0308; F17C 2203/0391; F17C 2203/0312; F17C 2203/0316; F17C 2270/01; F25D 19/00; F25D 19/003; Y02E 40/64; Y02E 40/641; Y02E 40/645; Y02E 40/647; F28F 2215/00; F28F 2215/06; F28F 2215/12; F28F 1/00; F28D 1/00
See application file for complete search history.

(56) References Cited

U.S. PATENT DOCUMENTS

| | | | | |
|---|---|---|---|---|
| 3,436,926 | A * | 4/1969 | Bogner | F17C 3/085 62/51.1 |
| 4,112,699 | A | 9/1978 | Hudson et al. | |
| 5,456,084 | A | 10/1995 | Lee | |
| 5,701,745 | A | 12/1997 | Cheng et al. | |
| 6,181,228 | B1 * | 1/2001 | Laskaris | F17C 3/085 335/300 |
| 6,698,212 | B2 | 3/2004 | Viegas et al. | |

(Continued)

*Primary Examiner* — Frantz Jules
*Assistant Examiner* — Erik Mendoza-Wilkenfe
(74) *Attorney, Agent, or Firm* — Mark Homer

(57) ABSTRACT

Disclosed herein is a cryogenic heat transfer system capable of transferring 50 W or more at cryogenic temperatures of 100° K or less for use with cryocooler systems. In an embodiment, a cryogenic heat transfer system comprises a refrigerant contained within an inner chamber bound by a condenser in fluid communication with an evaporator through at least one flexible conduit, the condenser in thermal communication with the cold station of a cryocooler, and the evaporator positionable in thermal communication with a heat source, typically a radiation shield of a cryogenic chamber. A process to remove heat from a cryogenic chamber is also disclosed.

16 Claims, 8 Drawing Sheets

(56) References Cited

U.S. PATENT DOCUMENTS

| | | | | |
|---|---|---|---|---|
| 7,131,277 | B2 | 11/2006 | Hall et al. | |
| 8,015,841 | B2 | 11/2011 | Cheng | |
| 8,938,979 | B2 | 1/2015 | Cheng | |
| 2008/0155994 | A1* | 7/2008 | Miyamoto | F25D 11/02 62/6 |
| 2009/0221426 | A1 | 11/2009 | Hazelton | |
| 2012/0279682 | A1 | 11/2012 | Bonnet et al. | |
| 2014/0069116 | A1* | 3/2014 | Durand | F25B 25/005 62/6 |

* cited by examiner

CRYOGENIC HEAT TRANSFER SYSTEM

RELATED APPLICATIONS

This application claims priority to U.S. provisional patent application No. 62/055,868, filed Sep. 26, 2014, which is fully incorporated by reference herein.

STATEMENT OF GOVERNMENT INTEREST

The invention described hereunder was made in the performance of work under NASA contract NNN12AA01C and is subject to the provisions of Public Law #96-517 (35 U.S.C. 202) in which the Contractor has elected not to retain title.

BACKGROUND

Cryocoolers have become available, which may be utilized to create and maintain cryogenic environments locally. These technologies reduce or eliminate the need to transport cryogen from a production facility to the location where it is needed, greatly reducing the cost of transportation, logistic and cryogen storage formerly required at the local site.

For small systems requiring heat extraction of less than about 40 watts, flexible heat straps made of braided copper wires and the like are available to provide the thermal link between the cryogenic cooling station and the heat source. However, cryogenic cooling and maintaining cryogenic conditions (i.e., at a temperature below about 100° K) within relatively large cryogenic chambers (i.e., chambers which require heat extraction on the order of 40 W or more) is problematic.

Although high capacity cryocoolers are available from several commercial sources, a thermal link between the cold head of the cryocooler and the relatively large cryogenic chamber is not available and thermal links known in the art are incapable of providing the heat transfer necessary to maintain cryogenic conditions on larger systems. As the temperature of the cryogenic system is reduced, thermal contraction of the components results in mechanical strains being exerted on the cold station of the cryocooler. Typically, the rated mass-force which may be applied to the cold station of the cryocooler is on the order of 10 kg in any direction. Traditional heat straps capable of providing heat extraction of more than about 40 W at temperatures of about 100° K or below are short and bulky. The required dimensions of such heat straps exert relatively large forces on the cold station due to thermal contraction, causing it to fail.

Attempts to address these issues include employment of longer heat straps, which are inherently more flexible than their shorter counterparts. However, as length is added the thermal resistances increases in a predictable way. It has been discovered that heat straps having the required length to exert less than 10 kg of force on a cold head upon cooling to cryogenic temperatures are ineffective for use in heat extraction of more than 40 W under cryogenic conditions. In short, thermal straps which are short enough and large enough to handle the heat load are too rigid for heat transfer above 40 W at cryogenic temperatures, and thermal straps large enough to provide the flexibility necessary to reduce the force applied to the cold station upon cooling to cryogenic temperatures are unacceptable for use with heat loads of 40 W or more due to thermal resistance. There is a need for a flexible heat transfer system for use with on-site cryogenic coolers which is capable of transferring 40 W, 50 W, or more at cryogenic temperatures of 100° K or less without exerting damaging forces on the cooling station of the cryocooler.

SUMMARY

The instant disclosure is generally directed to cryogenic heat transfer systems capable of transferring 50 W or more at cryogenic temperatures of 100° K or less for use with cryogenic cooler systems. In an embodiment, a cryogenic heat transfer system comprises a refrigerant contained within an inner chamber bound by a condenser in fluid communication with an evaporator through at least one flexible conduit. In embodiments, the condenser is positionable in thermal communication with a cold station of a cryocooler and the evaporator is positionable in thermal communication with a heat source, typically a radiation shield of a cryogenic chamber.

In embodiments, a process to remove heat from a cryogenic chamber comprises providing a cryogenic heat transfer system according to any one or combination of embodiments disclosed herein, in which the condenser is in thermal communication with a cold station of a cryocooler and the evaporator is in thermal communication with a heat source, e.g., a radiation shield of the cryogenic chamber; engaging the cryocooler thereby cooling the cold station to a temperature below about 100° K to thereby liquefy a portion of the refrigerant; then allowing the liquid refrigerant to flow from the condenser through the flexible conduit into the evaporator wherein the liquid refrigerant is vaporized within the evaporator thereby absorbing heat from the heat source (e.g., a radiation shield of a cryogenic chamber) allowing the refrigerant vapor to return through the same or another flexible conduit from the evaporator back into the condenser wherein the vaporized refrigerant is condensed and the cycle repeats, thereby removing heat from the cryogenic chamber or other heat source.

Other aspects and advantages of the invention will be apparent from the following description, drawings, and the appended claims.

DETAILED DESCRIPTION

Figure 1:
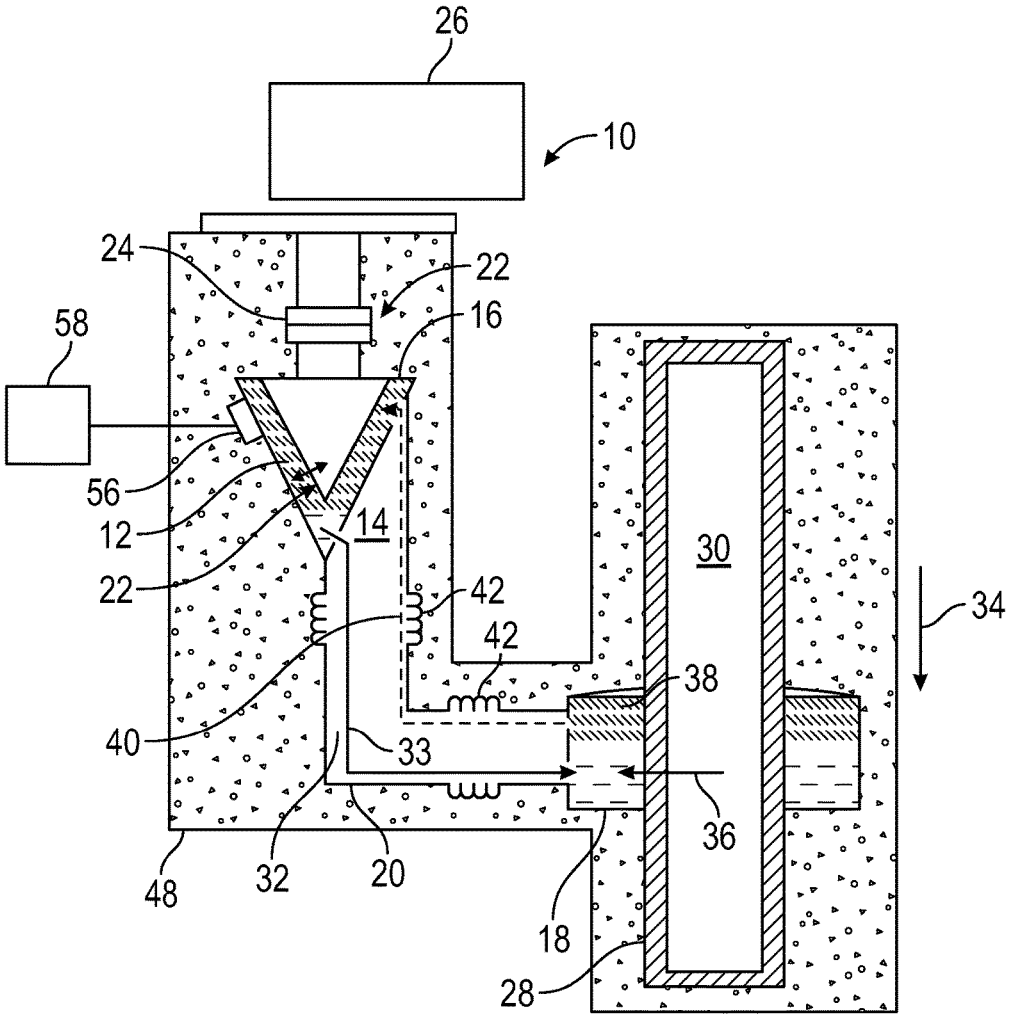
FIG. 1 shows a perspective view of a cryogenic heat transfer system according to embodiments of the instant disclosure having a single flexible conduit.

The following detailed description is of the best currently contemplated modes of carrying out the various aspects of this disclosure. The description is not to be taken in a limiting sense, but is made merely for the purpose of illustrating the general principles of the disclosure, since the scope of the disclosure is best defined by the appended claims.

In the following description, numerous specific details are set forth to provide a thorough understanding of the present disclosure. However, details unnecessary to obtain a complete understanding of the present disclosure may have been omitted in as much as such details are within the skills of persons of ordinary skill in the relevant art.

For purposes herein, a relatively large cryogenic chamber is defined as a chamber requiring extraction of greater than about 40 watts of energy (heat) to maintain cryogenic temperatures. Cryogenic temperatures are defined for purposes herein to be temperatures less than or equal to about 150° K (−123.15° C.). For purposes herein, a cryocooler is a device and/or system capable of reducing the temperature of a heat transfer component to cryogenic temperatures. This heat transfer component of the cryocooler is commonly known in the art and is referred to herein as a "cold station" or "cold head". It is to be understood that energy (heat) transferred into the cold station is eventually transferred into the external environment. Accordingly, energy transferred from a heat source via a heat transfer system to the cold station is eventually transferred to the external environment thus removing heat from the heat source.

As is known to one of skill in the art, cryogenic chambers are typically vessels disposed within other vessels. Depending on the desired temperature, a cryogenic chamber may include a plurality of vessels disposed within other vessels. The space between the vessels is often evacuated to insulate the inner vessel from the external environment. A surface of one or more of these inner vessels in direct or indirect thermal communication with the cryocooler may be referred to herein as a radiation shield of the cryogenic chamber. Accordingly, in embodiments, a radiation shield may be a vessel surface disposed within a vacuum chamber. However, the ability of the embodiments disclosed herein to efficiently transfer relatively large amounts of heat while maintaining cryogenic temperatures using portable cryocoolers renders embodiments disclosed herein suitable for a variety of purposes other than cooling cryogenic chambers. Suitable end uses may include providing cooling on various vent streams from chemical processes and/or shipping containers to prevent the escape of materials into the atmosphere. Examples include placing the evaporator according to one or more embodiments of the heat transfer system disclosed herein in thermal contact with a vent stream on cryogenic transport vessels such as are employed in LPG shipping vessels, wherein the cargo is stored and transported at cryogenic temperatures, but is necessarily vented to the atmosphere.

In an embodiment, a cryogenic heat transfer system comprises a refrigerant contained within a sealed inner chamber. For purposes herein, this sealed inner chamber refers to the closed space within, and thus bound by the condenser, the evaporator, and the flexible conduit(s) disposed between these components. Accordingly, the inner chamber in which the refrigerant is contained includes the inner space of the condenser, the inner space of the evaporator, and the inner space of one or more flexible conduits which connect the condenser to the evaporator. The inner chamber is sealed in that the refrigerant is contained within the inner chamber. However, it is to be understood that various valves may be present whereby refrigerant may be added or removed from the inner chamber. In embodiments, the condenser is in thermal communication with a cold station of a cryocooler, which may include the cold station being at least partially disposed within the condenser, and/or being integral to the condenser. In embodiments the evaporator is positionable in thermal communication with a heat source to be cooled to cryogenic temperatures. In embodiments, this heat source is a radiation shield of a cryogenic chamber or any subsystem that needs to be cooled.

In embodiments, the evaporator is arranged relative to the condenser such that liquid refrigerant flows from the condenser through the flexible conduit into the evaporator by gravity. Accordingly, in embodiments, the evaporator is located "downhill" from the condenser. Heat is removed via a condensation-evaporation cycle wherein vaporized refrigerant contacts a heat exchange surface with the condenser and is condensed into liquid refrigerant, the liquid refrigerant then flows from the condenser through the flexible conduit into the evaporator. The liquid refrigerant absorbs heat flowing from the heat source into the evaporator and is vaporized in the evaporator. This vaporized refrigerant is then transported back into the condenser, including being passively transported without the use of pumps (i.e., returns through the flexible conduit to the condenser) where it is once again condensed into a liquid thus releasing the heat previously absorbed to complete the cycle within this closed system. In embodiments, pumps and/or compressors are not required. The vaporized refrigerant is displaced from the evaporator by the liquid refrigerant flowing into the evaporator via gravity. The flow of the liquid refrigerant from the condenser to the evaporator, along with the condensation of the vaporized refrigerant in the condenser results in a negative pressure within a portion of the condenser that draws the vaporized refrigerant from the evaporator back into the condenser, as is readily understood by one of skill in the art.

In embodiments, the system comprises at least one flexible conduit, and the flexible conduit comprises at least one flexible expansion joint. In embodiments, the at least one flexible expansion joint is a metal-metal bellows joint, in which all of the surfaces in contact with the refrigerant are metallic. In embodiments, the at least one flexible conduit comprises at least one metal compensator joint, corrugated metal hose, spiral wound or stripwound metal hose, braded metal hose, or a combination thereof.

In embodiments, the cryogenic heat transfer system comprises one or more first flexible liquid supply conduit(s) through which liquid refrigerant flows from the condenser to the evaporator, and one or more second flexible vapor return conduit(s) through which the vaporized refrigerant flows from the evaporator to the condenser. Accordingly, in embodiments, a plurality of flexible conduits is employed to provide fluid and vapor communication between the condenser and the evaporator.

In embodiments, the condenser comprises an inner heat transfer member comprising an inverted frustoconical shape having a larger end separated from an apex end, wherein the larger end is arranged proximate to and in thermal communication with the cold station. In embodiments, the inner heat transfer member may be directly attached to the cold station and/or placed in thermal communication via employment of heat transfer mediums, such as various metallic foils and/or the like arranged between the physical connection of the inner heat transfer member and the cold station e.g., foil between a bolted flanged connection.

In embodiments, the inner heat transfer member is surrounded by and spaced apart from an inner surface of an outer jacket thereby forming a portion of the inner chamber in which the refrigerant is disposed. In embodiments, the flexible vapor return conduit is disposed through an upper portion of the outer jacket located at or proximate to the larger end of the frustoconical shape of the inner heat transfer member, and the flexible liquid supply conduit is disposed through a lower portion of the outer jacket located at or proximate to the apex of the frustoconical shape of the inner heat transfer member.

In embodiments, at least a portion of the inner surface of the outer jacket comprises a frustoconical shape complementary to, and spaced apart from the shape of the inner heat transfer member. Accordingly, in embodiments, there may be a uniform spacing between portions of the inner heat transfer member and the inner surface of the outer jacket. In embodiments, at least a portion of the inner heat transfer member comprises one or more flutes, channels, and/or fins disposed therein.

In embodiments, the refrigerant comprises nitrogen. In embodiments, at least a portion of the cryogenic heat transfer system is disposed within an insulating vacuum chamber in fluid communication with the radiation shield of the cryogenic chamber.

In embodiments, the cryogenic heat transfer system is dimensioned and arranged to transfer greater than or equal to about 50 watts of energy (i.e., heat), or 70 watts from the cryogenic chamber to the cryogenic cooling head at a temperature of less than or equal to about 100° K.

In embodiments, the cryogenic heat transfer system further comprises a thermostatically controlled heating system comprising a heating element in thermal communication with a surface of the inner chamber, operable to provide energy (i.e., heat) to control the temperature of the refrigerant above its freezing point and below about 100° K or another cryogenic temperature depending on the intended use.

In embodiments, a process to remove heat from a cryogenic chamber comprises of providing a cryogenic heat transfer system according to any embodiment or combination of embodiments disclosed herein in which the evaporator is in thermal communication with a radiation shield of the cryogenic chamber, cooling the cold station to a temperature below about 100° K to thereby liquefy a portion of the refrigerant, and allowing the liquid refrigerant to flow from the condenser through the flexible conduit into the evaporator, vaporize within the evaporator thereby absorbing heat from the radiation shield and return through the same or another flexible conduit from the evaporator back into the condenser wherein the vaporized refrigerant is condensed, thereby removing heat from the cryogenic chamber.

In embodiments of the process, greater than or equal to about 50 watts of energy are transferred from the radiation shield to the cryogenic cooling head at a temperature of less than or equal to about 100° K. In embodiments, the process further comprises arranging the evaporator relative to the condenser such that the liquid refrigerant flows from the condenser through at least one flexible conduit to the evaporator by gravity, thereby displacing and thus propelling or conveying the vaporized refrigerant through the same or another flexible conduit back into the condenser.

In embodiments, the process further comprises providing the cryogenic heat transfer system with a thermostatically controlled heating element in thermal communication with a surface of the inner chamber and operating or engaging the thermostatically controlled heating element (system) to provide heat to the cryogenic heat transfer system in an amount sufficient to control the refrigerant at a temperature above its freezing point and below about 100° K.

As shown in FIG. 1, in an embodiment, a cryogenic heat transfer system, generally referred to as 10, comprises a refrigerant 12 contained within an inner chamber 14 bound by a condenser 16 in fluid communication with an evaporator 18 through at least one flexible conduit 20. The condenser 16 is in thermal contact 22 with a cold station 24 of a cryocooler system 26. As shown in FIG. 1, the thermal contact 22 may be provided by a bolted flange connection or any other type of direct connection, with or without employing other heat transfer materials, as is known in the art. The evaporator 18 is shown positioned in thermal communication 36 with a radiation shield 28 of a cryogenic chamber 30. As shown, in an embodiment, the evaporator 18 is arranged downhill (via gravity 34) relative to the condenser 16 such that liquid refrigerant 32 (i.e., condensed refrigerant) flows from the condenser 16 through the flexible conduit 20 into the evaporator 18 via pathway 33 by gravity 34. As the liquid refrigerant 32 in the evaporator 18 absorbs energy (heat) via thermal communication 36 from the radiation shield, vaporized refrigerant 38 is formed, thereby extracting energy from the radiation shield 28 and ultimately from the cryogenic chamber 30. This vaporized refrigerant 38 then returns via path 40 back up into the flexible conduit 20 and eventually into the condenser 16 wherein the vaporized refrigerant 38 is condensed into the liquid refrigerant 32. In an embodiment, the vaporized refrigerant 38 is drawn into the condenser 16 by displacement caused by the liquid refrigerant 32 flowing into the evaporator 18 and the negative pressure caused by the vaporized refrigerant 38 condensing upon coming into thermal contact with the portion of the condenser 16 in thermal communication with cold station 24. Condensation of the vaporized refrigerant 38 transfers the heat into the cryocooler system 26, which is eventually transferred into the external environment.

As shown in FIG. 1, in an embodiment, the system comprises at least one flexible conduit 20, which comprises at least one flexible expansion joint 42. In embodiments, each of the plurality of flexible conduits 20 may be positioned and arranged to conduct both liquid refrigerant 32 (via path 33) into an evaporator 18 and vaporized refrigerant 38 (via path 40) back into the same condenser. In embodiments, at least a portion of the cryogenic heat transfer system 10 is disposed within an insulating chamber 48. In embodiments, the insulating chamber is evacuated to further minimize the transfer of energy into the cryogenic chamber.

Figure 4:
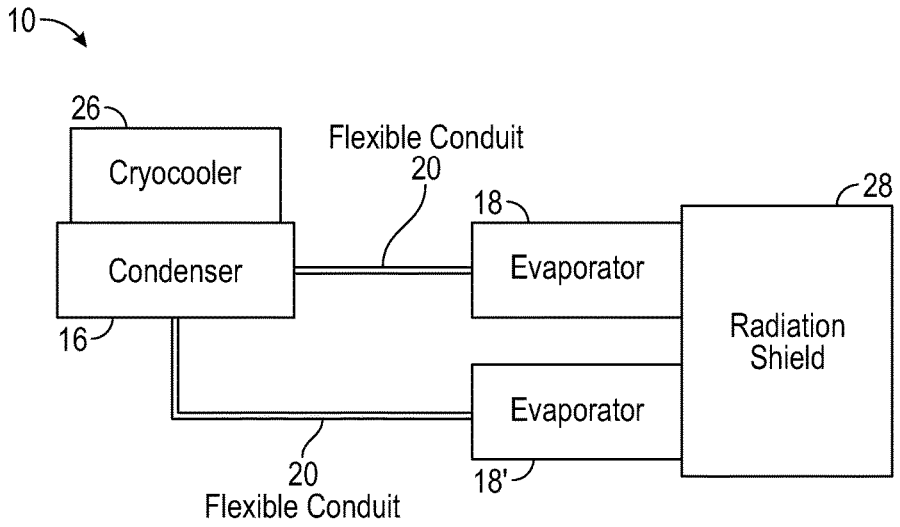
FIG. 4 is a block diagram showing embodiments of the heat transfer system according to the instant disclosure having a plurality of evaporators.
Figure 5:
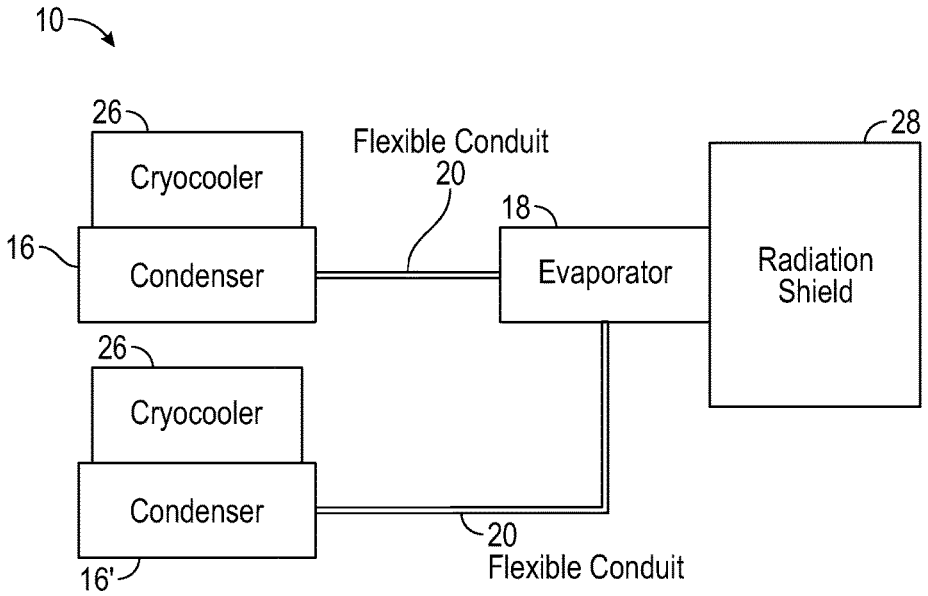
FIG. 5 is a block diagram showing embodiments of the heat transfer system according to the instant disclosure having a plurality of condensers.
Figure 6:
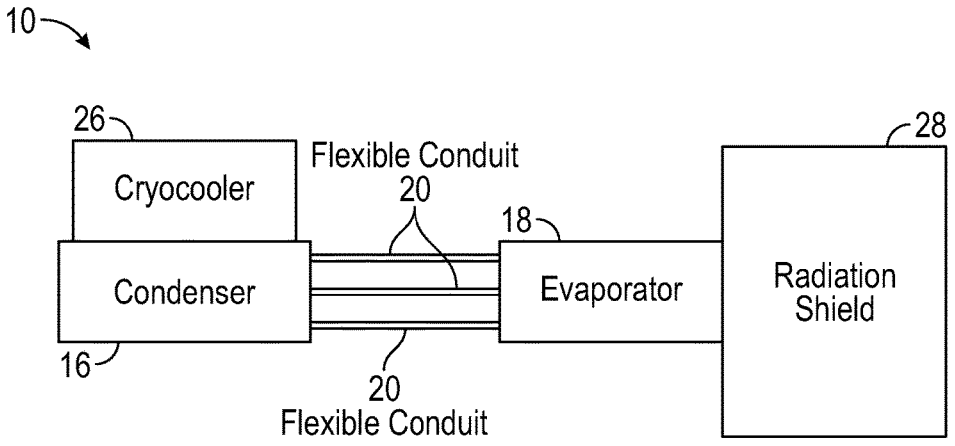
FIG. 6 is a block diagram showing embodiments in which a plurality of flexible conduits are disposed between the condenser and evaporator.

As shown via block diagram in FIG. 4, in embodiments, each of the flexible conduits 20 may be connected to the same condenser 16 but different evaporators 18 and 18', and/or as shown in the block diagram of FIG. 5, each of the flexible conduits 20 may be connected to different condensers 16 and 16' but the same evaporator 18. As shown by block diagram in FIG. 6, in embodiments, a plurality of flexible conduits 20 may flow between the cryogenic condenser 16 and the evaporator 18.

Figure 2:
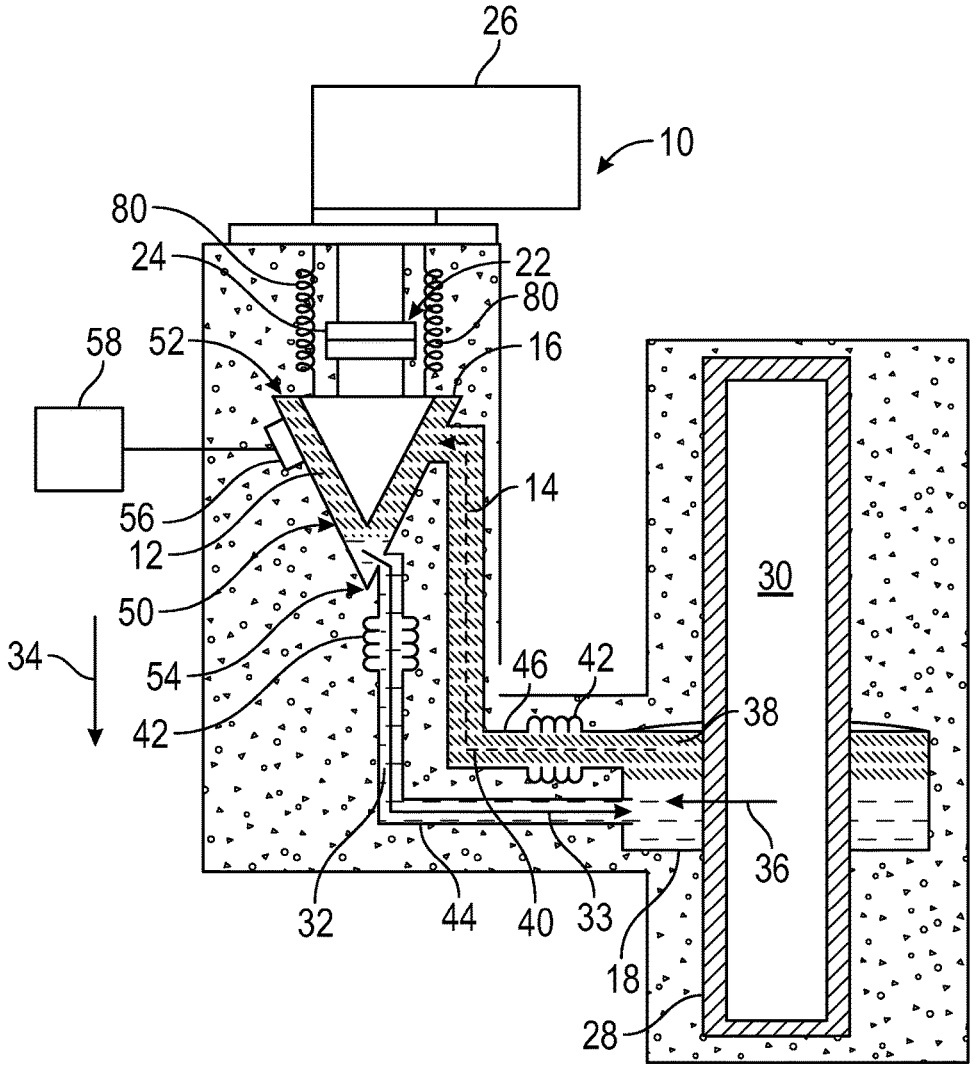
FIG. 2 shows a perspective view of an alternative cryogenic heat transfer system according to embodiments of the instant disclosure having two separate flexible conduits.

Turning to FIG. 2, in embodiments, the cryogenic heat transfer system 10 may comprise a plurality of flexible conduits providing fluid communication between the condenser 16 and the evaporator 18, which may further be adapted for a particular purpose. In embodiments, the system comprises at least one flexible liquid supply conduit 44 for conveying liquid refrigerant 32 (via path 33) from the condenser 16 to the evaporator 18, and at least one flexible vapor return conduit 46 for conveying vaporized refrigerant 38 from the evaporator 18 to the condenser 16.

In embodiments, the condenser 16 comprises an inverted frustoconical shape 50 having a larger end 52 arranged proximate to the cold station 24 of the cryocooler system 26, and a smaller end or apex end 54 located downhill from the larger end 52 into which the liquid refrigerant flows. In embodiments, the flexible liquid supply conduit 44 is attached at or proximate to the apex 54 of the frustoconical shape 50, and the flexible vapor return conduit 46 is attached at or proximate to the larger end 52 of the frustoconical shape proximate to the cold station 24.

In embodiments, the cryogenic heat transfer system may further comprise a thermostatically controlled heating element 56 coupled to a thermostatic control system 58, wherein the heating element 56 is in thermal communication with a surface of condenser 16. The heating element 56 is operable to provide heat to control the temperature of the refrigerant above its freezing point and below about 100° K. In embodiments, the condenser 16, and/or any of the other components of the heat transfer system may be suspended on one or more springs or other resilient members 80, which may be attached between the condenser 16 and the insulating chamber 48, a mounting flange of the cryocooler, or any other structure capable of bearing a portion of the load produced by the mass of the condenser 16 and/or the other components of the system 10. Accordingly, one or more springs may be employed to alleviate the force placed on the cold station.

Figure 3:
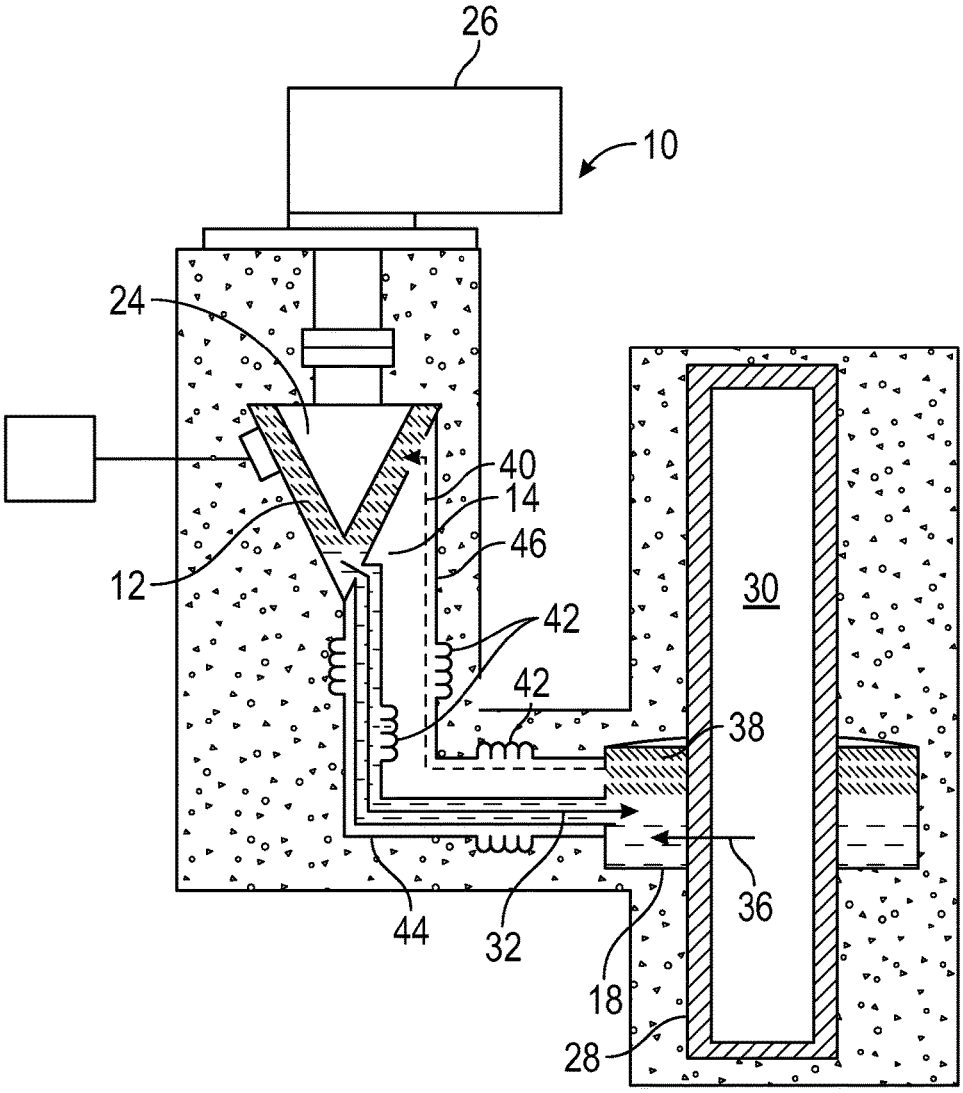
FIG. 3 shows a perspective view of an alternative cryogenic heat transfer system according to embodiments of the instant disclosure having two separate flexible conduits arranged coaxially.

As shown in FIG. 3, in an embodiment, at least a portion of the flexible liquid supply conduit 44 may be coaxial with at least a portion of the flexible vapor return conduit 46.

Figure 13:
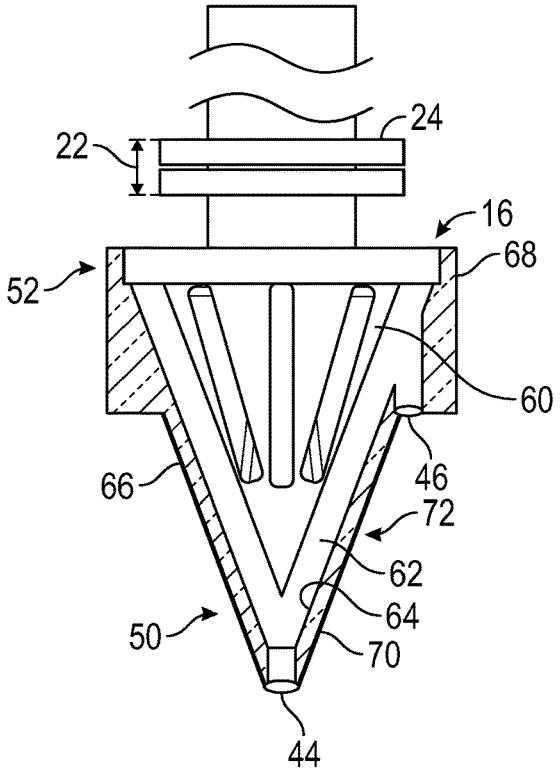
FIG. 13 is a side view of a condenser in thermal communication with a cold station according to embodiments of the instant disclosure.

As shown in FIG. 13, in embodiments, the condenser 16 comprises an inner heat transfer member comprising an inverted frustoconical shape having the larger end 52 separated from the apex end 50, wherein the larger end 52 is arranged proximate to and in direct thermal communication 22 with the cold station 24. In embodiments, the inner heat transfer member 60 is surrounded by, and spaced apart 62 from, an inner surface 64 of an outer jacket 66 thereby forming a portion of the inner chamber 14 in which the refrigerant is disposed. In embodiments, the flexible vapor return conduit 46 is disposed through an upper portion 68 of the outer jacket 66 located at or proximate to the larger end 52 of the frustoconical shape of the inner heat transfer member 60, and the flexible liquid supply conduit 44 is disposed through a lower portion 70 of the outer jacket 66 located at or proximate to the apex 50 of the frustoconical shape of the inner heat transfer member 60. As shown in FIG. 13, in embodiments, at least a portion of the inner surface of the outer jacket comprises a frustoconical shape complementary 72 to the shape of the inner heat transfer member.

Figure 14:
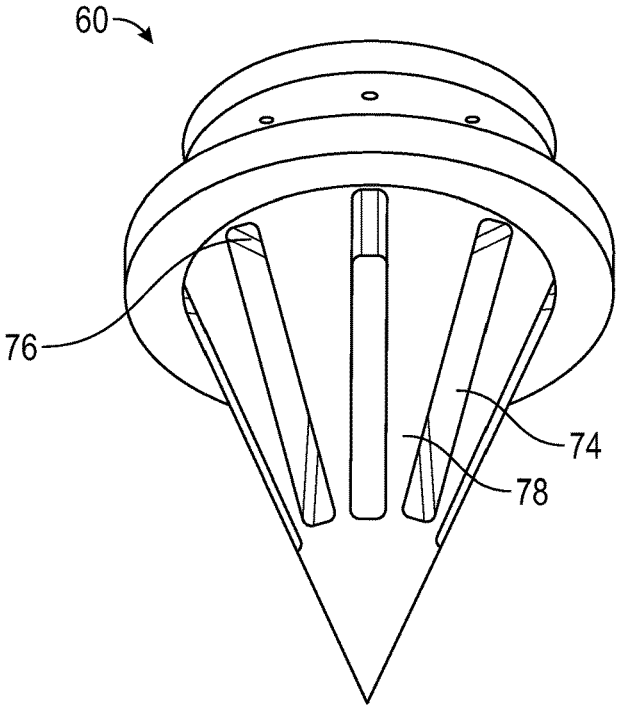
FIG. 14 is a perspective side view of the inner heat transfer member shown in FIG. 13.

As shown in FIG. 14, in embodiments, the at least a portion of the inner heat transfer member 60 comprises one or more flutes 74, channels 76, and/or fins 78 disposed therein. In embodiments, the inner heat transfer member 60 may comprise one or more metal components. In embodiments, the inner heat transfer member 60, and/or any one or more of the various components of the heat transfer system may comprise copper, aluminum, or another metal.

In embodiments, each flexible conduit e.g., 20, 44, and/or 46 may comprise at least one expansion joint 42, or may be comprised of expansion joints in the form of a metal corrugated hose or spiral wound hose, which allows for changes in shape as the conduit contracts or expands due to changes in temperature.

Figure 7:
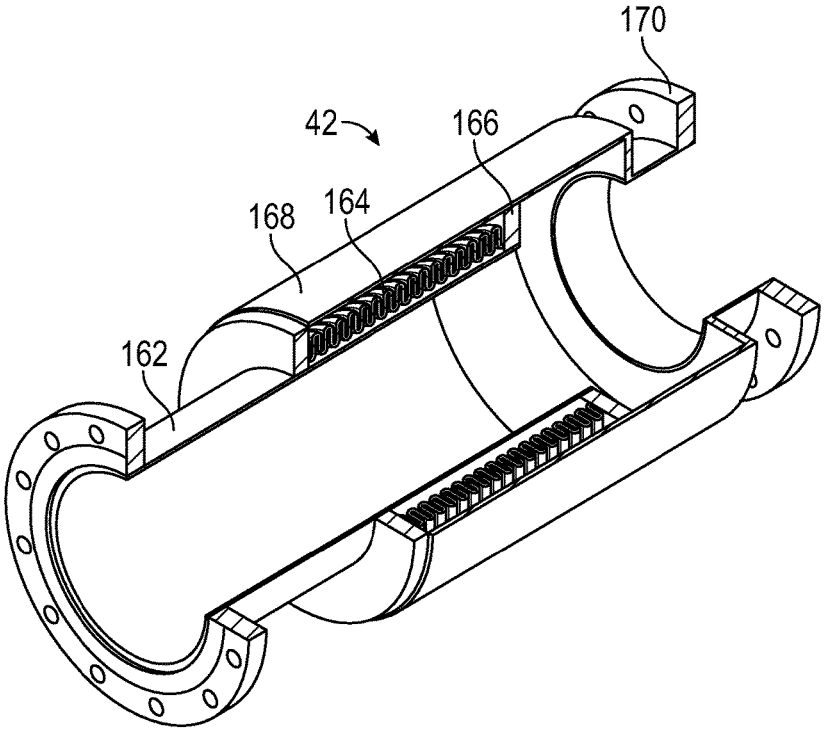
FIG. 7 is a perspective cut-away view of a thermal compensator joint which a flexible conduit may comprise according to embodiments of the instant disclosure.
Figure 8:
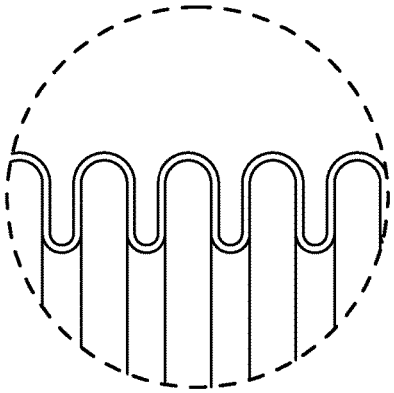
FIG. 8 is a partial cross sectional view of a flexible metal hose show in FIG. 9, which a flexible conduit may comprise according to embodiments of the instant disclosure.
Figure 9:
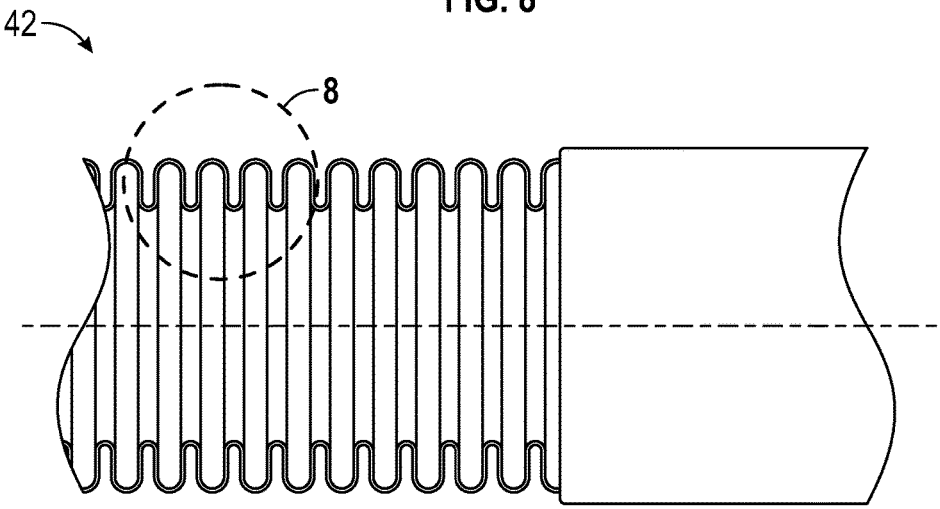
FIG. 9 is an overhead view of a flexible metal hose, which a flexible conduit may comprise according to embodiments of the instant disclosure.
Figure 10:
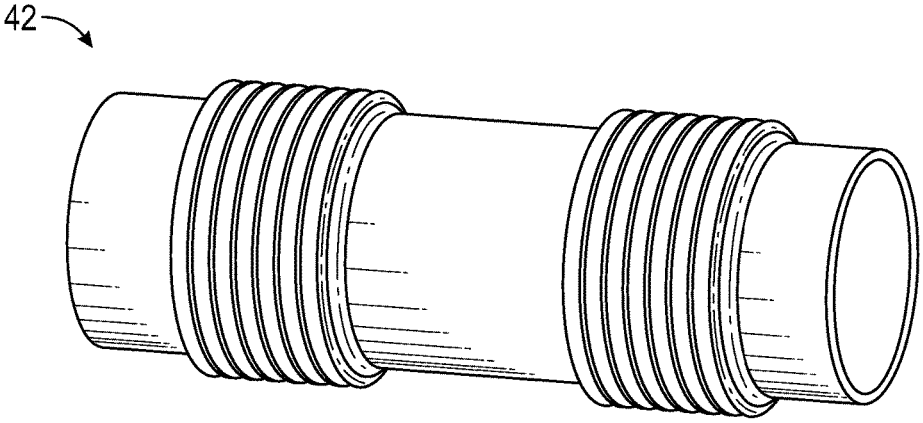
FIG. 10 is a perspective view of metal-metal bellows expansion joint, which a flexible conduit may comprise according to embodiments of the instant disclosure.
Figure 11:
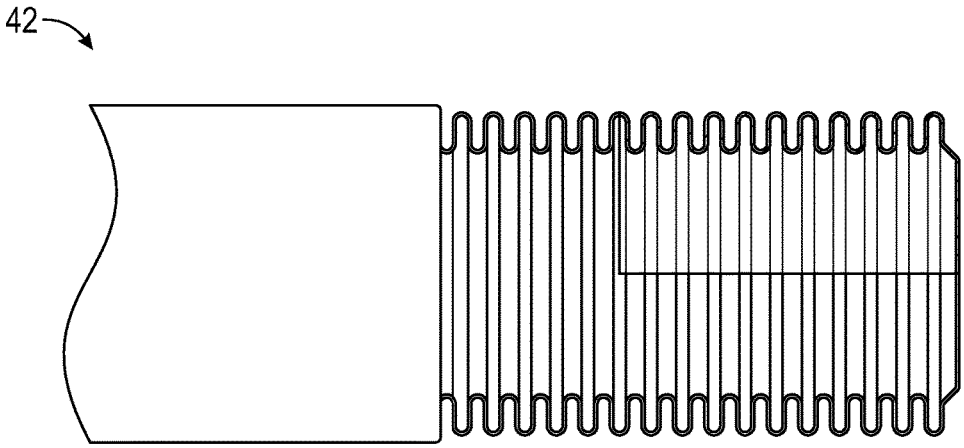
FIG. 11 is a partial cut-away view of a spiral wound metal hose, which a flexible conduit may comprise according to an embodiments of the instant disclosure.
Figure 12:
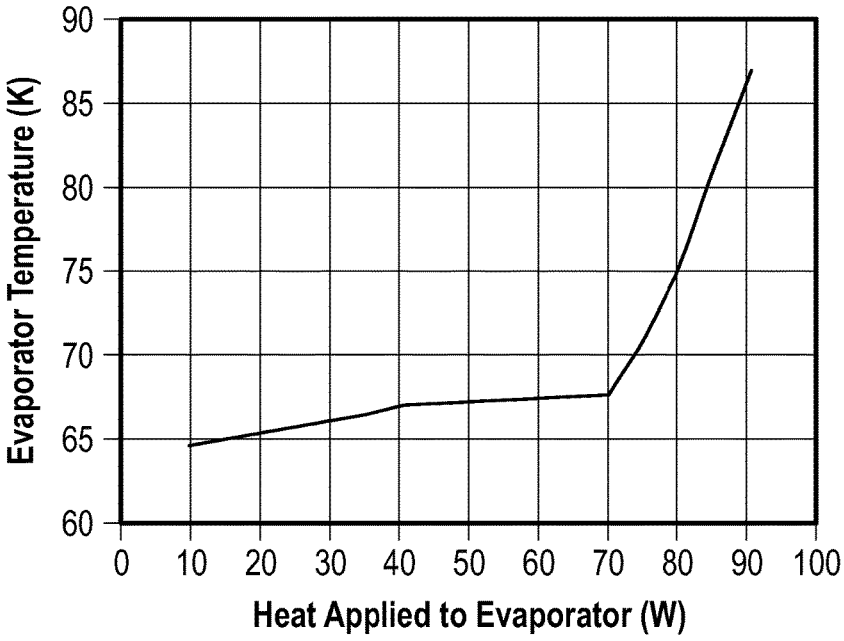
FIG. 12 is a chart in which the evaporator temperature is plotted relative to heat applied to a test unit according to an embodiment of the instant disclosure.

In embodiments, the flexible expansion joint 42 may be a flexible metal-metal bellows joint as shown in FIG. 10, wherein all of the surfaces in contact with the refrigerant are metallic. Other suitable expansions joints include compensator joints as shown in FIG. 7, comprising a movable pipe 162, which moves laterally within, and is sealing engaged via 164 and 166 with a surrounding base pipe 168. As shown in FIG. 7, the flexible expansion joint may be flanged 170, may be welded, or attached to the evaporator and/or condenser by any other suitable attachment means. In embodiments, the flexible conduit comprise a metal corrugated hose, a partial cross section of which is shown in FIG. 8 and a side view of which is shown in FIG. 9. Other suitable flexible conduits include metal stripwound hose as shown in FIG. 11, comprising a plurality of metal spirals interlocked to allow them to be flexible yet provide a sealed conduit. As is also shown in FIG. 11, in embodiments, the flexible conduit may comprise a metal braded hose alone, or in combination with one or more other flexible conduits.

In embodiments, the refrigerant is a gas at 25° C. and 1 atm pressure. Any cryogenic refrigerant may be used. In embodiments, the refrigerant comprises, consists of, or consists essentially of nitrogen. Other suitable refrigerants include hydrogen, noble gases, and the like.

In embodiments, the cryogenic heat transfer system is dimensioned and arranged to transfer greater than or equal to about 50 watts, or greater than or equal to about 70 watts, or greater than or equal to about 100 watts, or greater than or equal to about 500 watts (of heat energy) from the cryogenic chamber to the cryogenic cooling head at cryogenic temperatures. In embodiments, the cryogenic temperatures are maintained at less than or equal to about 150° K, or 100° K, or 80° K.

In embodiments, a process to remove heat from a cryogenic chamber, comprises i. providing a cryogenic heat transfer system according to any one or combination of embodiments disclosed herein;

ii. operating or otherwise engaging the cryocooler to cool the cold head to a temperature below about 100° K and thereby liquefy a portion of the refrigerant;

iii. allowing the liquid refrigerant to flow from the condenser through the flexible conduit into the evaporator, vaporize within the evaporator thereby absorbing heat from the radiation shield and return through the same or another flexible conduit from the evaporator back into the condenser wherein the vaporized refrigerant is condensed, thereby removing heat from the cryogenic chamber.

In embodiments, the process may further comprise providing the cryogenic heat transfer system with a thermostatically controlled heating element in thermal communication with a surface of the inner chamber; and operating or otherwise engaging the thermostatically controlled heating element to provide heat to the system in an amount sufficient to control the refrigerant at a temperature above its freezing point, and below the desired cryogenic temperature e.g., about 150° K or less than about 100° K.

EMBODIMENTS

Embodiments according to the instant disclosure include:

A. A cryogenic heat transfer system comprising a refrigerant contained within an inner chamber bound by a condenser in fluid communication with an evaporator through at least one flexible conduit, the condenser positionable in thermal communication with a cold station of a cryocooler, and the evaporator positionable in thermal communication with a radiation shield of a cryogenic chamber.

B. The cryogenic heat transfer system according to embodiment A, wherein the evaporator is arranged relative to the condenser such that liquid refrigerant flows from the condenser through the flexible conduit to the evaporator by gravity.

C. The cryogenic heat transfer system according to embodiment A or B, wherein the at least one flexible conduit comprises at least one flexible expansion joint.

D. The cryogenic heat transfer system according to any one of embodiments A through C, comprising at least one flexible conduit comprising at least one flexible metal-metal bellows joint, compensator joint, corrugated hose, stripwound hose, metal braded hose, or a combination thereof.

E. The cryogenic heat transfer system according to any one of embodiments A through D, comprising both a flexible liquid supply conduit and a flexible vapor return conduit providing fluid communication between the condenser and the evaporator.

F. The cryogenic heat transfer system according to any one of embodiments A through E, wherein a surface of the condenser within the inner chamber comprises at least a portion of the cryogenic cooling head such that at least a portion of the cold station is in physical contact with the refrigerant.

G. The cryogenic heat transfer system according to any one of embodiments A through F, wherein the condenser comprises an inner heat transfer member comprising an inverted frustoconical shape having a larger end separated from an apex end, wherein the larger end is arranged proximate to and in direct thermal communication contact with the cold station; wherein the inner heat transfer member is surrounded by and spaced apart from an inner surface of an outer jacket thereby forming a portion of the inner chamber in which the refrigerant is disposed, wherein the flexible vapor return conduit is disposed through an upper portion of the outer jacket located at or proximate to the larger end of the frustoconical shape of the inner heat transfer member, and wherein the flexible liquid supply conduit is disposed through a lower portion of the outer jacket located at or proximate to the apex of the frustoconical shape of the inner heat transfer member.

H. The cryogenic heat transfer system according to embodiment G, wherein at least a portion of the inner surface of the outer jacket comprises a frustoconical shape complementary to the shape of the inner heat transfer member.

I. The cryogenic heat transfer system according to embodiments G or H, wherein at least a portion of the inner heat transfer member comprises one or more flutes, channels, and/or fins disposed therein.

J. The cryogenic heat transfer system according to any one of embodiments A through I, wherein at least a portion of the flexible liquid supply conduit is coaxial with the flexible vapor return conduit.

K. The cryogenic heat transfer system according to any one of embodiments A through J, wherein the refrigerant comprises nitrogen and/or a noble gas, wherein the condenser, the evaporator, or both comprise copper, or a combination thereof.

L. The cryogenic heat transfer system according to any one of embodiments A through K, wherein at least a portion of the cryogenic heat transfer system is disposed within an insulating evacuated chamber in fluid communication with the radiation shield of the cryogenic chamber.

M. The cryogenic heat transfer system according to any one of embodiments A through L, dimensioned and arranged to transfer greater than or equal to about 50 watts from the cryogenic chamber to the cryogenic cooling head at a temperature of less than or equal to about 100° K.

N. The cryogenic heat transfer system according to any one of embodiments A through M, dimensioned and arranged to transfer greater than or equal to about 70 watts from the cryogenic chamber to the cryogenic cooling head at a temperature of less than or equal to about 100° K.

O. The cryogenic heat transfer system according to any one of embodiments A through N, further comprising a thermostatically controlled heating element in thermal communication with a surface of the inner chamber, operable to provide heat to control the temperature of the refrigerant within the condenser above a freezing point of the refrigerant and below about 100° K; and/or further comprising one or more resilient members such as a spring attached between the condenser and an inner surface of the insulating chamber.

P. A process to remove heat from a cryogenic chamber, comprising:

i. providing a cryogenic heat transfer system according to any one of embodiments A through O;

ii. cooling the cold station to a temperature below about 100° K to thereby liquefy a portion of the refrigerant; and iii. allowing the liquid refrigerant to flow from the condenser through the flexible conduit into the evaporator, vaporize within the evaporator thereby absorbing heat from the radiation shield and return through the same or another flexible conduit from the evaporator back into the condenser wherein the vaporized refrigerant is condensed, thereby removing heat from the cryogenic chamber.

Q. A process to remove heat from a cryogenic chamber, comprising:

i. providing a cryogenic heat transfer system comprising a refrigerant contained within an inner chamber bound by a condenser in fluid communication with an evaporator through at least one flexible conduit, the condenser in thermal communication with a cold stage of cryocooler, and the evaporator in thermal communication with a radiation shield of the cryogenic chamber;

ii. cooling the cold stage to a temperature below about 100° K to thereby liquefy a portion of the refrigerant; and iii. allowing the liquid refrigerant to flow from the condenser through the flexible conduit into the evaporator, vaporize within the evaporator thereby absorbing heat from the radiation shield and return through the same or another flexible conduit from the evaporator back into the condenser wherein the vaporized refrigerant is condensed, thereby removing heat from the cryogenic chamber.

R. The process according to embodiments P or Q, wherein the flexible conduit comprises at least one flexible metal-metal bellows joint, metal corrugated hose, or a combination thereof.

S. The process according to any one of embodiments P through R, wherein at least a portion of the cryogenic heat transfer system is disposed within a vacuum chamber in fluid communication with the radiation shield of the cryogenic chamber.

T. The process according to any one of embodiments P through S, wherein greater than or equal to about 50 watts are transferred from the radiation shield to the cold stage of a cryocooler at a temperature of less than or equal to about 100° K.

U. The process according to any one of embodiments P through T, further comprising arranging the evaporator relative to the condenser such that the liquid refrigerant flows from the condenser through the at least one flexible conduit to the evaporator by gravity, thereby propelling the vaporized refrigerant through the same or another flexible conduit back into the condenser.

V. The process according to any one of embodiments P through U, further comprising:

iv. providing the cryogenic heat transfer system with a thermostatically controlled heating element in thermal communication with a surface of the inner chamber; and v. operating the thermostatically controlled heating element to provide heat to the system in an amount sufficient to control the refrigerant at a temperature above its freezing point and below about 100° K.

EXAMPLES

A cryogenic heat transfer system was constructed according to embodiments disclosed herein. The condenser was formed from copper metal and comprised an inner heat transfer surface comprising an inverted frustoconical shape surrounded by a complimentary outer jacket. A flexible vapor return conduit comprising a flexible bellows metal hose was soldered to the outer jacket of the condenser proximate to the larger end of the frustoconical shape. A flexible liquid supply conduit comprising a flexible bellows metal hose was attached directly to the apex of the outer jacket frustoconical shape. Both flexible conduits were attached to the evaporator via flanged connections. The condenser was bolted to the cold station of the cryocooler with a piece of indium foil disposed between the two to improve thermal conductivity. Nitrogen was used as the refrigerant. For test purposes the heat load was simulated by a heating element attached to the heat transfer surface of the evaporator. The entire unit was disposed within an evacuated chamber an operated as described herein. The condenser was equipped with a thermostatically controlled heater. The condenser was maintained at 63° K, just above the freezing point of the nitrogen refrigerant. Heat was then supplied to the evaporator via engaging the heating element. As the data in FIG. 13 shows, the system effectively transferred heat from 10 W up to about 70 W, demonstrating the utility of the heat transfer system. Above 70 W, the large increase in temperature indicates the useful operational range of the cryocooler. The useful operational range of the heat transfer system is larger than 70 W. Although the mass of the mass of condenser is 10 kg, it is suspended by a plurality of springs. Therefore, the load on the cold station is reduced to less than 0.1 kg, well within the manufacturer's specification.

All documents described herein are incorporated by reference herein, including any patent applications and/or testing procedures to the extent that they are not inconsistent with this application and claims. Although only a few example embodiments have been described in detail above, many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures.

We claim:

1. A cryogenic heat transfer system comprising a refrigerant contained within an inner chamber bound by a condenser in fluid communication with an evaporator through at least one conduit, the condenser positionable in thermal communication with a cold station of a cryocooler, and the evaporator positionable in thermal communication with a radiation shield of a cryogenic chamber; further comprising both a liquid supply conduit and a vapor return conduit providing fluid communication between the condenser and the evaporator, wherein the condenser comprises an inner heat transfer member comprising an inverted frustoconical shape having a larger end separated from an apex end, wherein the larger end is arranged proximate to and in direct thermal communication contact with the cold station; wherein the inner heat transfer member is surrounded by and spaced apart from an inner surface of an outer jacket thereby forming a portion of the inner chamber in which the refrigerant is disposed, wherein the vapor return conduit is disposed through an upper portion of the outer jacket located at or proximate to the larger end of the frustoconical shape of the inner heat transfer member, and wherein the liquid supply conduit is disposed through a lower portion of the outer jacket located at or proximate to the apex of the frustoconical shape of the inner heat transfer member.

2. The cryogenic heat transfer system of claim 1, wherein the evaporator is arranged relative to the condenser such that liquid refrigerant flows from the condenser through the conduit to the evaporator by gravity.

3. The cryogenic heat transfer system of claim 1, wherein the at least one flexible conduit comprises at least one expansion joint.

4. The cryogenic heat transfer system of claim 1, wherein the at least one conduit comprises at least one metal-metal bellows joint, compensator joint, corrugated hose, strip-wound hose, metal braded hose, or a combination thereof.

5. The cryogenic heat transfer system of claim 1, wherein at least a portion of the inner surface of the outer jacket comprises a frustoconical shape complementary to the shape of the inner heat transfer member.

6. The cryogenic heat transfer system of claim 1, wherein at least a portion of the inner heat transfer member comprises one or more flutes, channels, and/or fins disposed therein.

7. The cryogenic heat transfer system of claim 1, wherein at least a portion of the liquid supply conduit is coaxial with the vapor return conduit.

8. The cryogenic heat transfer system of claim 1, wherein the refrigerant comprises nitrogen, wherein the condenser, the evaporator, or both comprise copper, or a combination thereof.

9. The cryogenic heat transfer system of claim 1, wherein at least a portion of the cryogenic heat transfer system is disposed within an insulating evacuated chamber in fluid communication with the radiation shield of the cryogenic chamber.

10. The cryogenic heat transfer system of claim 1, further comprising a thermostatically controlled heating element in thermal communication with a surface of the inner chamber, operable to provide heat to control the temperature of the refrigerant within the condenser above a freezing point of the refrigerant and below about 100° K.

11. A process to remove heat from a cryogenic chamber, comprising:

providing a cryogenic heat transfer system comprising a refrigerant contained within an inner chamber bound by a condenser in fluid communication with an evaporator through at least one conduit, the condenser in thermal communication with a cold station of a cryocooler, and the evaporator in thermal communication with a radiation shield of the cryogenic chamber; further comprising both a liquid supply conduit and a vapor return conduit providing fluid communication between the condenser and the evaporator, wherein the condenser comprises an inner heat transfer member comprising an inverted frustoconical shape having a larger end separated from an apex end, wherein the larger end is arranged proximate to and in direct thermal communication contact with the cold station; wherein the inner heat transfer member is surrounded by and spaced apart from an inner surface of an outer jacket thereby forming a portion of the inner chamber in which the refrigerant is disposed, wherein the vapor return conduit is disposed through an upper portion of the outer jacket located at or proximate to the larger end of the frustoconical shape of the inner heat transfer member, and wherein the liquid supply conduit is disposed through a lower portion of the outer jacket located at or proximate to the apex of the frustoconical shape of the inner heat transfer member cooling the cold station to a temperature below about 100° K to thereby liquefy a portion of the refrigerant; and allowing the liquid refrigerant to flow from the condenser through the conduit into the evaporator, vaporize within the evaporator thereby absorbing heat from the radiation shield and flow through the same or another conduit from the evaporator back into the condenser wherein the vaporized refrigerant is condensed, thereby removing heat from the cryogenic chamber.

12. The process of claim 11, wherein the at least one conduit comprises at least one expansion joint.

13. The process of claim 11, wherein at least a portion of the cryogenic heat transfer system is disposed within a vacuum chamber in fluid communication with the radiation shield of the cryogenic chamber.

14. The process of claim 11, wherein greater than or equal to about 50 watts are transferred from the radiation shield to the cryogenic cooling head at a temperature of less than or equal to about 100° K.

15. The process of claim 11, further comprising arranging the evaporator relative to the condenser such that the liquid refrigerant flows from the condenser through the at least one conduit into the evaporator by gravity.

16. The process of claim 11, further comprising:

providing the cryogenic heat transfer system with a thermostatically controlled heating element in thermal communication with a surface of the inner chamber; and operating the thermostatically controlled heating element to provide an amount of heat to the condenser sufficient to control the temperature of the refrigerant within the condenser above a freezing point of the refrigerant and below about 100° K.

* * * * *